United States Patent [19]

Drevfors et al.

[11] Patent Number: 4,840,205

[45] Date of Patent: Jun. 20, 1989

[54] METHOD AND APPARATUS FOR DISPENSING LIQUIDS

[75] Inventors: Gunnar Drevfors, Mendota Heights; Donald G. Corniea, Inver Grove Heights; Norman J. Paulson, Maple Grove, all of Minn.

[73] Assignee: Tetra Pak Finance & Trading S.A., Pully, Switzerland

[21] Appl. No.: 216,335

[22] Filed: Jul. 8, 1988

[51] Int. Cl.[4] ..... B65B 3/04

[52] U.S. Cl. ..... 141/2; 141/114; 417/472; 417/510; 92/38

[58] Field of Search ..... 141/1, 2, 114, 284; 222/207, 209, 212, 213, 504, 451, 453, 381; 239/453; 417/472, 473, 510; 92/38, 44, 37

[56] References Cited

U.S. PATENT DOCUMENTS

| | | | |
|---|---|---|---|
| 2,492,280 | 12/1949 | Groves | 137/493.3 |
| 3,514,222 | 5/1970 | Korotkov et al. | 417/214 |
| 4,402,461 | 9/1983 | Mosse et al. | 239/453 |
| 4,437,498 | 3/1984 | Pankratz et al. | 141/89 |
| 4,515,530 | 5/1985 | Christoleit | 417/214 |
| 4,648,421 | 3/1087 | Chant et al. | 137/312 |

FOREIGN PATENT DOCUMENTS

| | | | |
|---|---|---|---|
| 2315701 | 11/1973 | Fed. Rep. of Germany | 141/284 |

*Primary Examiner*—Henry J. Recla
*Assistant Examiner*—J. Casimer Jacyna
*Attorney, Agent, or Firm*—Burns, Doane, Swecker & Mathis

[57] ABSTRACT

A machine for dispensing liquids, especially for filling cartons at a higher rate of speed, is disclosed. The machine includes three bellows arranged in vertical alignment, with upper and lower sleeves interposed between the bellows. The discharge nozzle is located below the lowest bellows. The upper sleeve moves axially relative to the nozzle to control the opening and closing of the discharge valve. The lower sleeve also moves axially to control the filling and recharging of the bellows directly above the discharge nozzle. The method of operating the components in timed relation to achieve effective and efficient carton filling, as well as draining and cleaning, is disclosed.

14 Claims, 5 Drawing Sheets

Fig. 2
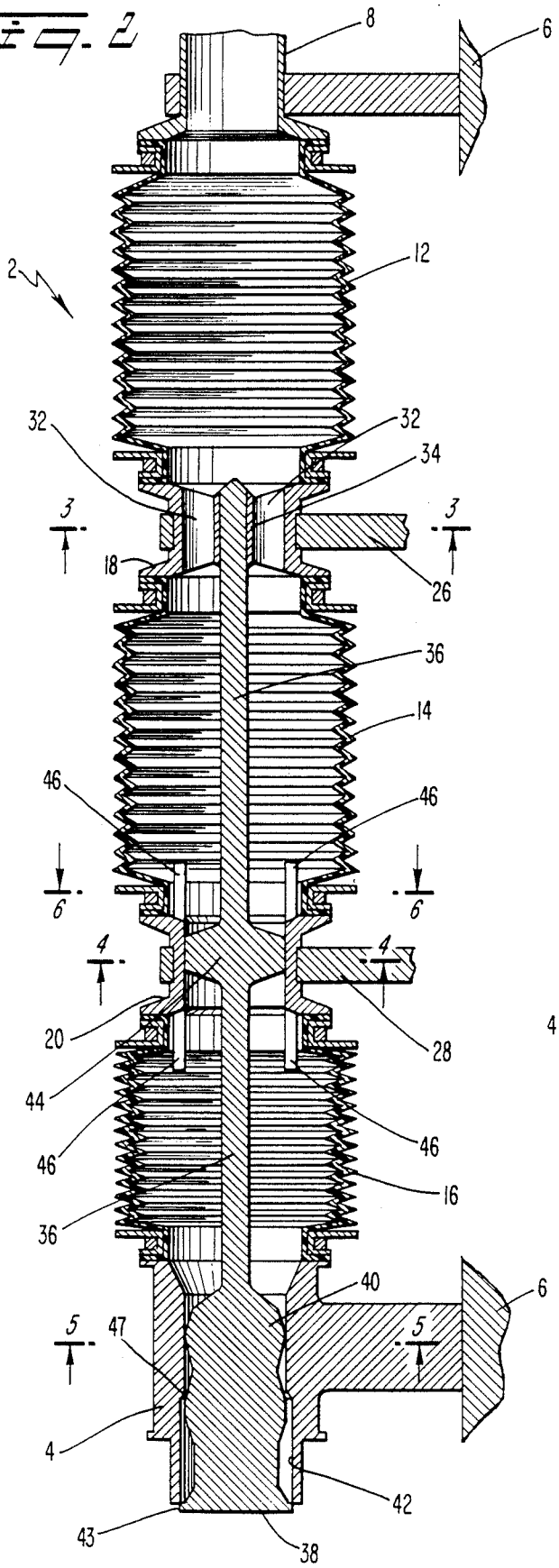
Fig. 3
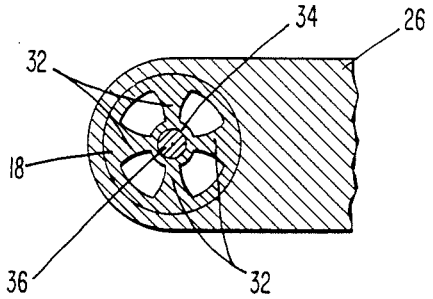
Fig. 4
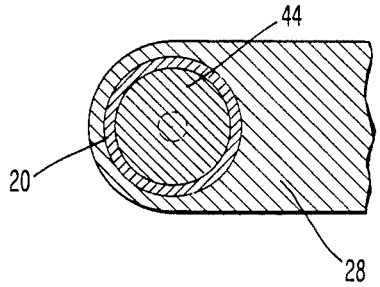
Fig. 5
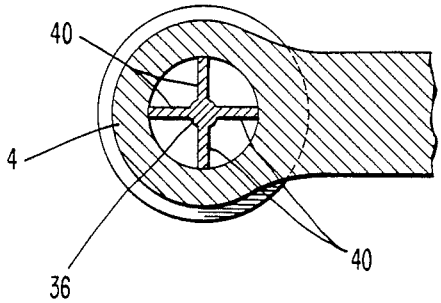
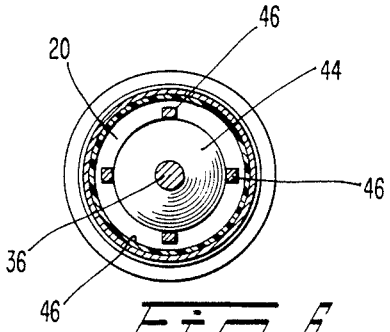
Fig. 6

Fig. 7
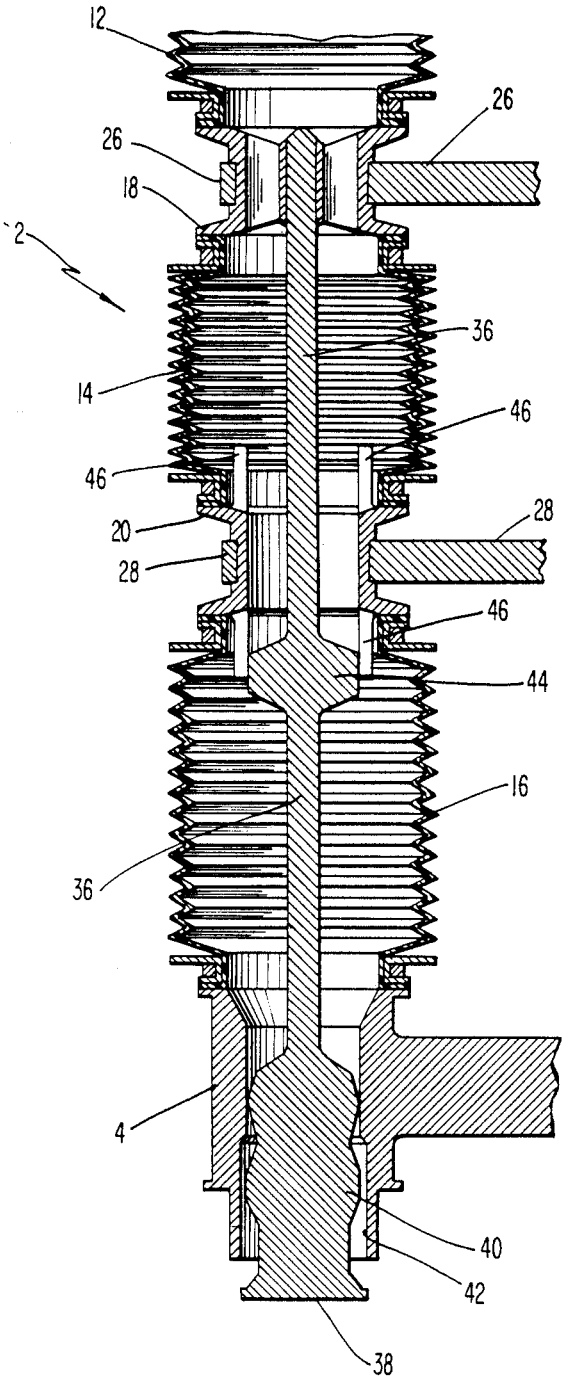
Fig. 8
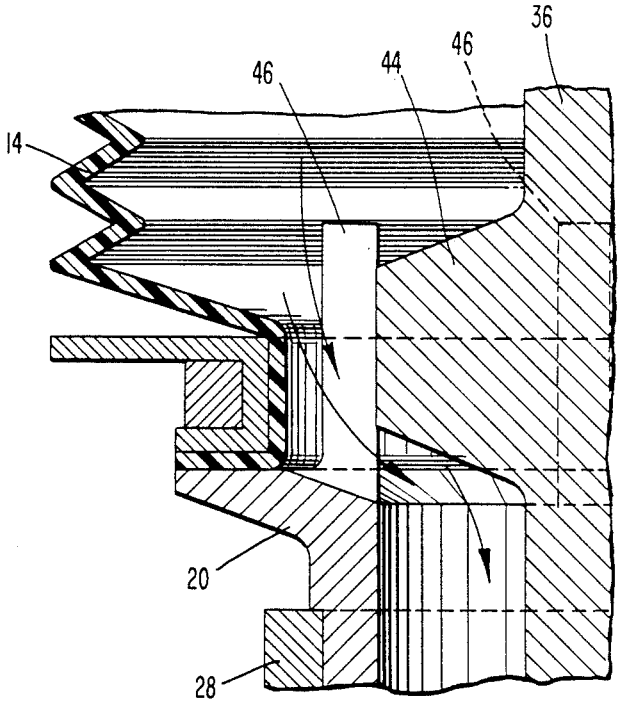
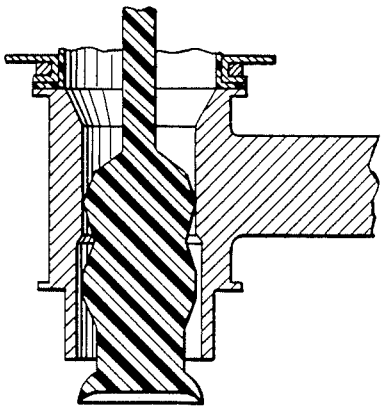
Fig. 9

METHOD AND APPARATUS FOR DISPENSING LIQUIDS

BACKGROUND OF THE INVENTION

The present invention relates to automatic filling machines wherein empty cartons are conveyed along a path while being filled with liquid and sealed, and more particularly to liquid dispensing units for such machines.

High speed automatic filling machines such as is disclosed in U.S. Pat. No. 4,448,008, have been used for filling cartons with liquids, such as milk and juices. These filling machines are required to dispense a predetermined quantity of liquid in each carton as it advances through the filling section of the machine.

One type of dispensing unit that has been used is a double bellows type apparatus such as that disclosed in U.S. Pat. No. 4,402,461. This patent discloses a dispensing unit having a pair of bellows interconnected by an activator sleeve containing a valve that controls the flow of fluid from the upper bellows to the lower bellows. A discharge valve is mounted at the lower end of the lower bellows. The actuator sleeve is mounted for reciprocating movement in an axial direction, and the end of each bellows that is connected with the sleeve moves with it. The opposite ends of the respective bellows are held stationary, so that the axial movement of the body in one direction compresses one of the bellows and expands the other.

An hydraulic or pneumatic ram vertically raises the actuator sleeve causing the upper bellows to contract while simultaneously expanding the lower bellows. This action opens the central valve in the sleeve and pump liquid from the upper bellows into the lower bellows. The ram then lowers the activator sleeve which expands the upper bellows while simultaneously contracting the lower bellows. A spring on the control valve causes the valve to close. This allows the upper bellows to be refilled with liquid from the supply pipe at the top of the upper. The increase in pressure in the lower bellows acts on the discharge valve to overcome the force of the return spring so that the discharge valve opens to allow the liquid to flow from the lower bellows into a carton. The sequence is then repeated sequentially transferring liquid from the supply source into the upper bellows, then into the lower bellows, and finally into individual cartons, as they move past the discharge valve.

Since these dispensing units are used primarily for food products, such as milk, or other dairy products, the unit must be cleaned thoroughly after each use. If the flow passages in the dispensing unit have shoulders or irregular surfaces, there is a risk that some of the liquid or food product may be trapped on these surfaces. Furthermore, if there are springs or other obstructions in the interior of the dispensing unit, it is difficult to clean. Since health regulations require these filling machines to be thoroughly cleaned every day they are used, it is important that the structure of the dispensing unit facilitate the cleaning and sterilization process.

To facilitate cleaning of the dispensing unit, it is desirable to provide for complete draining of the liquid from the system. To accomplish this, any valves in the dispensing unit must remain open during the draining process.

When the system is being filled with liquid product, before starting to fill cartons, any air in the system must be purged to avoid introducing bacteria into the cartons. With prior systems, the air has been removed by operating the dispensing unit while supplying liquid to the unit. The first several cartons that are filled are then discarded, since air is entrained in the liquid contents of the carton. This is a wasteful way to purge the air.

Another important requirement for these dispensing units is that the volume of liquid that is dispensed into each carton must be accurately controlled, so that the carton is not overfilled. Excess liquid may wet the adhesive surface and interfere with sealing of the carton.

It has been proposed to use these dispensing units for food products that contain chunks or particles in a liquid, such as soups. In order to accommodate these chunks or particles, the flow path for the liquid must be free of obstructions, and the valve openings must be large enough that the chunks or particles are not trapped as they are being dispensed.

SUMMARY AND OBJECTS OF THE INVENTION

In view of the deficiencies of prior liquid dispensing units, particularly for food products, it is an object of this invention to provide a liquid dispensing unit which is accurate and efficient in dispensing liquids.

It is a further object of this invention to provide a liquid dispensing unit that is capable of being thoroughly and efficiently cleaned.

A still further object is to provide for purging the air from the dispensing unit quickly and efficiently when the unit is being filled after having been drained.

Another object of the invention is to provide a liquid dispensing unit in which the liquid being dispensed may contain chunks or particles without the chunks or particles being trapped in the dispensing unit.

These objects are accomplished according to the present invention by providing three axially aligned bellows assemblies with a pair of movable sleeves interposed between the bellows at opposite ends of the middle bellows. A discharge valve is provided in a stationary housing at the lower end of the lower bellows.

A valve stem extends from the valve element of the discharge valve through the lower sleeve to a rigid connector in the upper sleeve. An intermediate valve element is secured on the valve stem in position to cooperate with the lower sleeve to control flow between the middle and lower bellows. Axial displacement of the upper sleeve causes displacement of the intermediate valve element and the discharge valve by means of the valve stem. The intermediate valve element controls the flow of liquid from the supply source to the lower bellows that is associated with the discharge valve. The lower sleeve that cooperates with the intermediate valve element includes guides extending above and below the sleeve, so that the valve element can be moved relative to the sleeve to allow the passage of fluid around the valve element. When the valve element is in either a raised or lowered position, a liquid flow path between the middle bellows and the lower bellows is provided. Axial displacement of the upper and lower sleeves is provided by appropriate motor means, so that the upper sleeve controls the opening and closing of the discharge valve, while the motion of the lower sleeve controls the flow of liquid through the bellows.

BRIEF DESCRIPTION OF THE DRAWINGS

A preferred embodiment of the invention is illustrated in the accompanying drawings, in which:

FIG. 2 is a cross-sectional view of the dispensing unit shown in FIG. 1;

FIG. 3 is a cross-sectional view of the dispensing unit along the line 3—3 in FIG. 2;

FIG. 4 is a cross-sectional view of the dispensing unit along the line 4—4 in FIG. 2;

FIG. 5 is a cross-sectional view of the dispensing unit along the line 5—5 in FIG. 2;

FIG. 6 is a cross-sectional view of the dispensing unit along the line 6—6 in FIG. 2;

FIG. 7 is a cross-sectional view of the dispensing unit as in FIG. 2, but showing the valve open for draining and cleaning;

FIG. 8 is an enlarged cross-sectional view of the flow control valve in the raised position for filling and recharging;

FIG. 9 is a cross-sectional view of the discharge valve, as in FIG. 2, but showing a modified form of the preferred embodiment;

DETAILED DESCRIPTION

Figure 1:
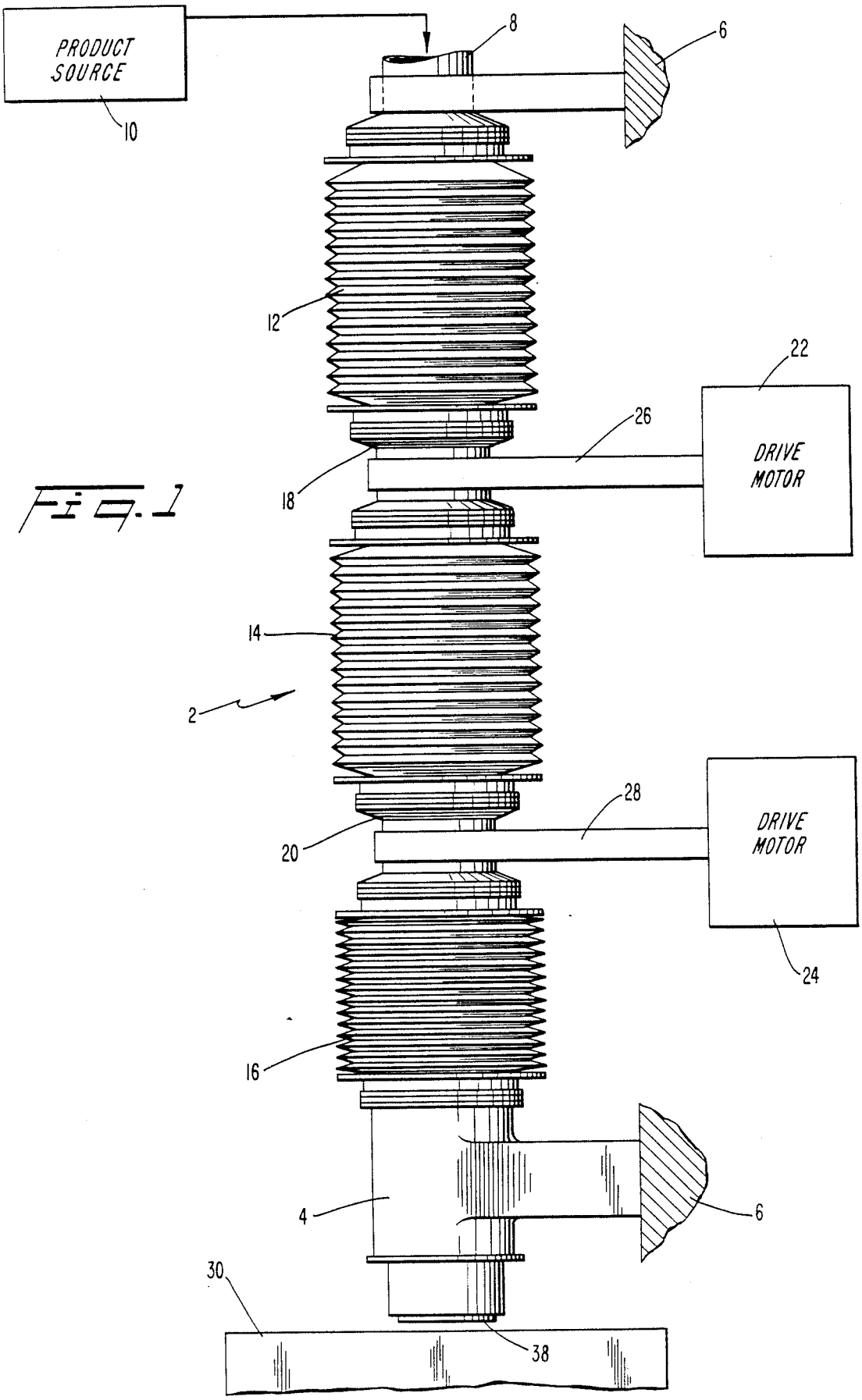
FIG. 1 is an elevational view, partially schematic, showing the liquid dispensing unit in accordance with this invention.

A preferred embodiment of the liquid dispensing unit of this invention is shown in FIG. 1. The dispensing unit 2 includes a discharge nozzle 4 which is mounted on the machine frame, shown schematically at 6. A supply conduit 8 is also rigidly supported on the machine frame 6 for receiving liquid product from a product source 10. Preferably, the product source 10 is a tank that elevated above the dispensing unit, so that the liquid product in the tank flows by gravity into the dispensing unit. The dispensing unit includes an upper bellows 12, a middle bellows 14 and a lower bellows 16. The upper end of the upper bellows 12 is held stationary by being mounted on the frame 6. The lower end of the upper bellows 12 is coupled to a sleeve 18 which is preferably formed of metal or rigid plastic. The upper end of the middle bellows 14 is coupled to the lower end of the sleeve 18, and the lower end of the bellows 14 is coupled to the upper end of a lower sleeve 20, which is also preferably formed of metal or rigid plastic. The upper end of the lower bellows 16 is coupled to the lower end of the sleeve 20, and the lower end of the bellows 16 is coupled to a discharge nozzle 4. The discharge nozzle 4, the bellows 12, 14 and 16, the sleeves 18 and 20, and the supply conduit 8 are substantially aligned along a vertical axis.

Each of the sleeves 18 and 20 are connected with drive motors 22, 24 respectively by arms 26 and 28. The drive motors, which may be in the form of cam mechanisms, hydraulic or pneumatic rams, servo motors or other conventional devices, provide a linear force on the arms 26 and 28 for imparting reciprocating motion to the sleeves 18 and 20 along the central vertical axis of the bellows 12, 14 and 16. Although two motors 22, 24 are shown, it is recognized that a single motor with a sprocket and chain, or other suitable arrangement could be used to control and coordinate the reciprocating motions of the sleeves 18 and 20. A carton 30 which is to be filled by product flowing out of the nozzle 4 is shown in FIG. 1 in position to be filled.

Referring to FIGS. 2 and 3, the upper sleeve 18 includes radial webs 32 which support a hub 34 in which a valve stem 36 is secured.

As shown in FIG. 2, the stem 36 extends upwardly from the discharge valve element 38 which is mounted in the nozzle 4. The valve element 38 includes radial guides 40 (FIG. 5) which center the valve in the nozzle, while allowing fluid to pass. The nozzle 4 has an internal bore 42 which corresponds to the diameter of lip 43 of the valve element 38, so that the valve can move upwardly into the interior of the nozzle 4 upon vertical movement of the stem 36. When the valve element 38 is positioned in the bore 42, the valve element 38 prevents liquid from flowing out of the nozzle.

A control valve element 44 is secured on the stem and cooperates with the sleeve 20, as shown in FIGS. 2 and 4. Preferably, the element 44 and the element 38 are formed of plastic and are molded integrally with the stem 36. The valve element, when in the position shown in FIG. 2, prevents fluid flow between the middle bellows 14 and the lower bellows 16. The sleeve 20 also includes guides 46 extending upwardly and downwardly from the sleeve to retain the sleeve 20 in axial alignment with the bellows when the valve element 44 is either above or below the sleeve 20. As shown in FIG. 6, four guides 46 are provided in this preferred embodiment. When the valve stem 36 is raised to the top if its stroke, the lip 43 of the valve element 38 engages a shoulder 47 (FIG. 2) in the nozzle bore 42 to provide a seal against leakage of liquid.

As can be seen from FIG. 2, the upper bellows 12 receives liquid product by gravity from the supply conduit 8. The liquid flows downwardly freely between the radial webs 3 in the upper sleeve 18 and into the interior of the middle bellows 14, so that both of these bellows are maintained full of liquid. When the sleeve 18 is raised relative to the sleeve 20, so that the valve element 44 is in the position shown in FIG. 8, liquid flows around the valve element 44 and into the lower bellows 16. When the stem 36 is raised to this position, the discharge valve element 38 is also raised relative to the nozzle 44, so that the valve element engages the shoulder 47 in the bore 42, and liquid cannot flow out of the nozzle 4. When the dispensing unit is being filled, air is purged from the unit by being displaced by the liquid as it fills progressively upward from the nozzle 4. As the air is displaced, it passes upwardly through the supply conduit 8 and into the tank of the product source 10.

When the liquid product that is being dispensed through this dispensing unit is a food product, it is necessary to sterilize the interior of the unit periodically. Cleaning the flow passages of the dispensing unit of this invention can be carried out efficiently and effectively. To clean the dispensing unit, the upper sleeve 18 is displaced downwardly by the drive motor 22 acting by means of the arm 26 until the discharge valve 38 is in the position shown in FIG. 7. At the same time, the drive motor 24 displaces the lower sleeve 20 upwardly through the arm 28 to the position shown in FIG. 7, so that the valve element 44 is positioned below the sleeve 20. As can be seen from FIG. 7, when the valve element 44 and the discharge valve 38 are in this position, liquid is free to drain from the unit by flowing around the valve element 44 and out of the nozzle 4 around the valve 38. For cleaning purposes, the product supply is shut off, and the conduit 8 is connected with a cleaning solution which flows downwardly from the conduit 8 through the bellows 14 and the bellows 16 and out past the discharge valve 38. In this manner, the liquid product can be drained from the unit rapidly, and cleaning can be carried out quickly and efficiently.

In using this dispensing unit for filling cartons, a predetermined quantity of liquid is dispensed during each cycle of opening and closing the discharge valve, so that the carton will be filled to the proper level. The apparatus of this invention provides accurate control of the quantity of liquid that is dispensed. The movement of the upper sleeve 18 relative to the fixed nozzle 4 determines when the discharge valve opens and closes. By adjusting the frequency of the reciprocating motion imparted to the arm 26 by the drive motor 22, the duration that the discharge valve is opened can be accurately controlled. The pressure in the lower bellows 16 remains constant as the stem 36 moves downwardly since the cross-sectional areas of the element 44 is the same as that of the element 43. When the lip 43 of the discharge valve 38 is below the end of the nozzle 4, liquid is discharged through the opening between the lip 43 and the nozzle 4. The alignment of the valve element 44 with the sleeve 20 prevents flow between the bellows 14 and 16. After the valve element 38 opens, the sleeve 20 is displaced downwardly by the motor 24 to compress the bellows 16 and therby to discharge a predetermined quantity of product liquid as the sleeve 20 moves downwardly.

Figure 12:
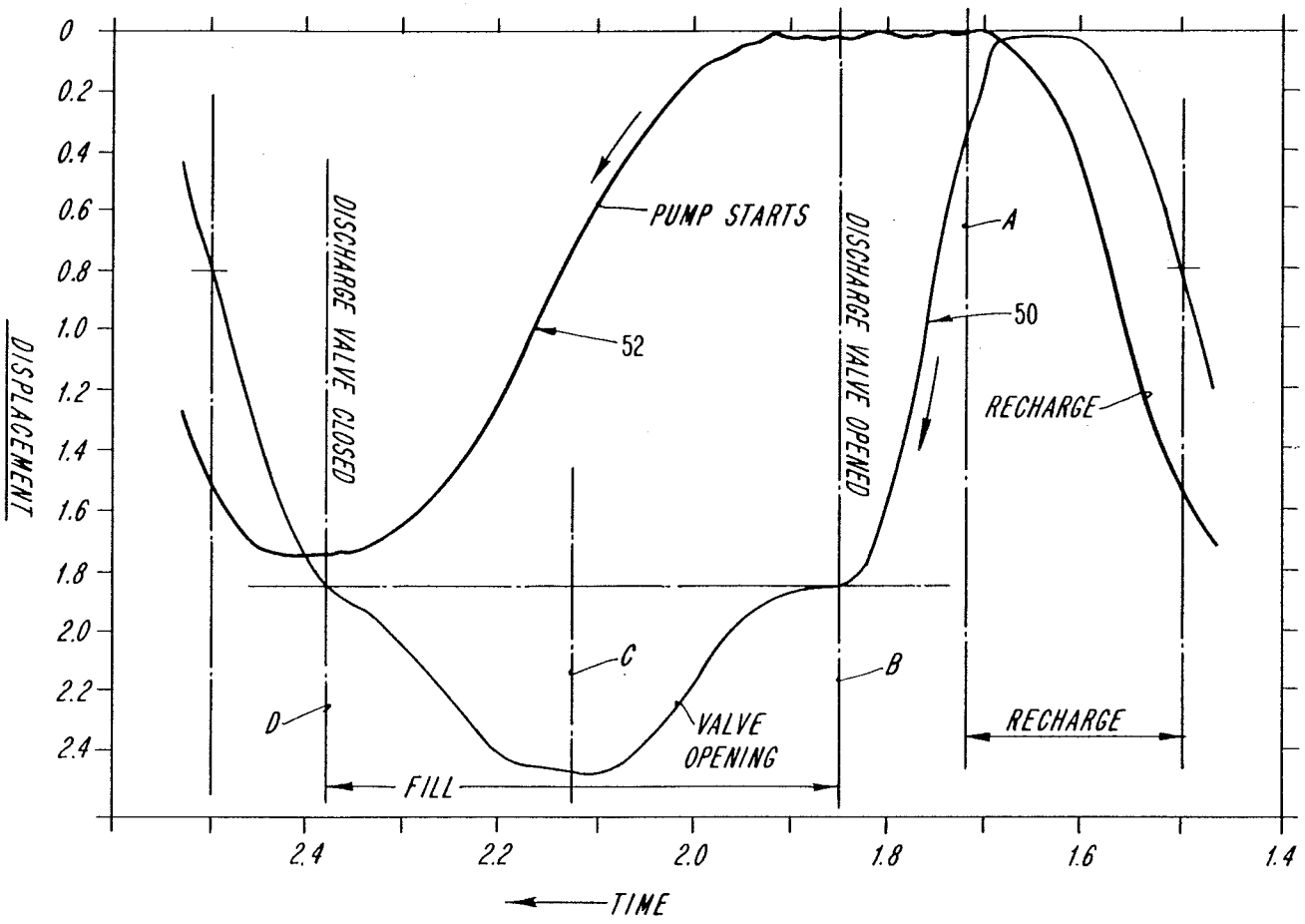
FIG. 12 is a motion diagram showing the relative displacements of the upper and lower sleeves in relation to the control valve and the discharge valve.

A motion diagram showing the relative movement of the discharge valve 38 and the pump stroke of the sleeve 20 during one cycle is provided in FIG. 12. The line 50 shows the displacement of the valve element 38 relative to the nozzle 4, so that the zero displacement on the line 50 corresponds to the raised position of the element 38 with the lip 43 in engagement with the shoulder 47. The maximum displacement corresponds to the valve element 38 being fully open. The line 52 shows the displacement of the sleeve 20 from the raised position (closed) at the right side of FIG. 12 to the opened position shown in the mid portion of FIG. 12.

Figure 10A:
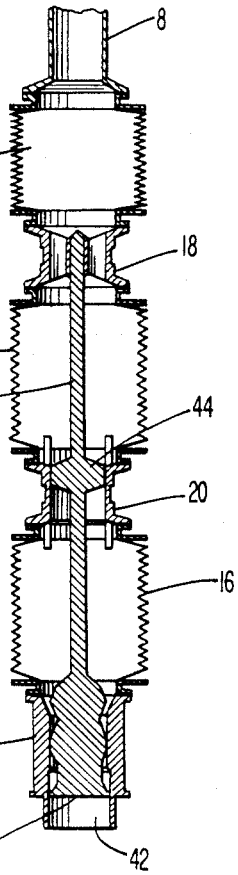
FIG. 10A is a schematic view showing the components of the dispensing unit before filling cycle begins.
Figure 10B:
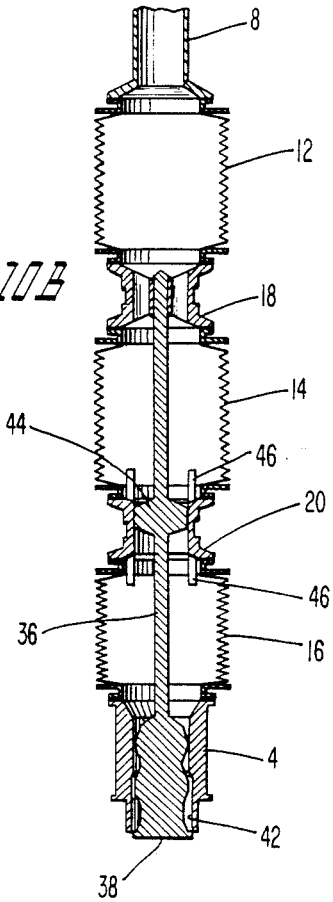
FIG. 10B is a schematic view as in FIG. 10A, but when filling begins.
Figure 10C:
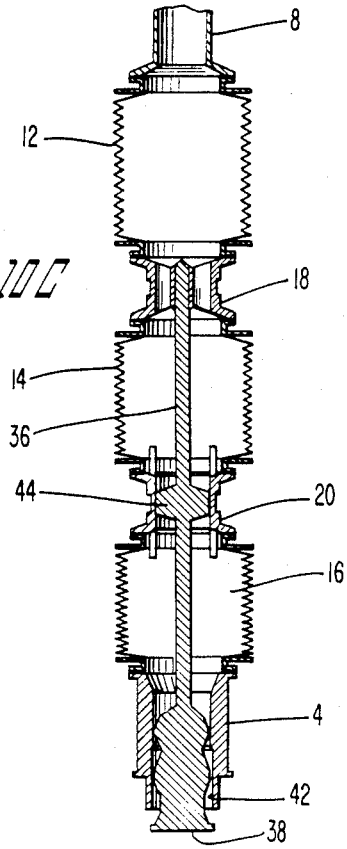
FIG. 10C is a schematic view as in FIG. 10A, but at the middle of the filling.
Figure 10D:
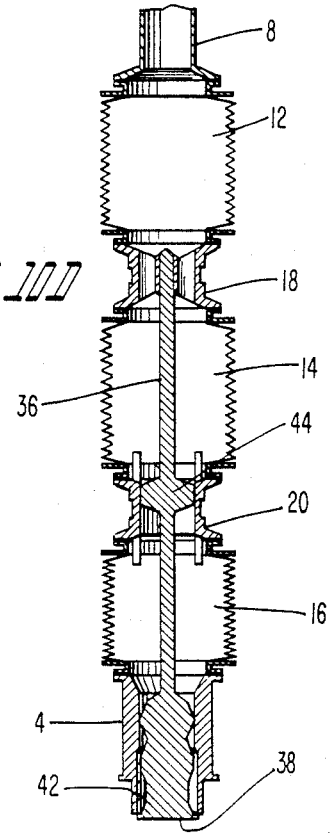
FIG. 10D is a schematic view as in FIG. 10A, but when filling cycle ends.

The carton filling cycle is illustrated in FIGS. 10A–10D. The cycle begins with the discharge valve 38 at a raised position in the bore 42, as shown in FIG. 10A. The positions of the components shown in FIG. 10A corresponds to the time indicated at A in FIG. 12. The control valve element 44 is aligned with the sleeve 20, and, of course, the bellows 16 is filled with liquid product. The filling cycle begins with a downward movement of the valve stem 36 while the sleeve 20 remains stationary. This movement displaces the discharge valve element 38 downwardly to the position shown in FIG. 10B where the product is discharged around the element 38 at the lower end of the nozzle bore 42 (time B in FIG. 12). When the discharge valve 38 approaches the lower end of the bore 2, the sleeve 20 begins moving downwardly, so that the control valve 44 continues to remain closed, while the fluid volume in the bellows 16 decreases to compensate for the discharge of the volume. The discharge valve 38 continues to move below the nozzle 4 to increase the flow rate of the liquid product out of the nozzle 4 and into the carton. The middle of the filling segment is shown at time C in FIG. 12. And the positions of the components are shown in FIG. 10C. The flow rate depends primarily upon the gap between the lip 43 of the discharge valve element 38 and the lower end of the bore 42 in the nozzle 4, which gap is readily adjustable by adjustment of the stroke of the upper sleeve 18.

When the time has elapsed for the discharge valve to be open, the upper sleeve 18 begins to move upwardly while the lower sleeve 20 remains stationary. This raises the valve element 38 until it is received in the bore 42. During this time, the sleeve 20 remains stationary. The flow of liquid stops when the valves are in the position shown in FIG. 10D (time D in FIG. 12).

Figure 11:
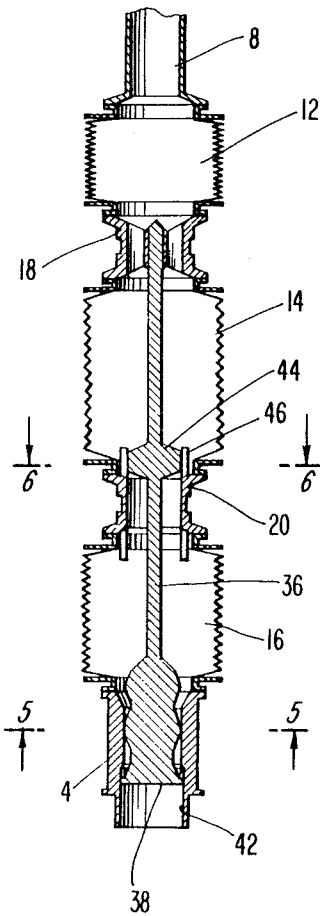
FIG. 11 is a schematic view showing the positions of the components of the dispensing unit during the recharge cycle.

After the carton fill cycle, it is necessary to replenish the supply of liquid in the lower bellows 16, and this is accomplished by raising the upper sleeve 18 to the position shown in FIG. 11A. This movement raises the control valve element 44 above the sleeve 20, so that liquid can flow around the guides 46 from the middle bellows 14 into the lower bellows 16 in the manner shown in FIG. 8. The lower sleeve 20 then moves upwardly as shown in FIG. 12 to expand the lower bellows 16 to receive the additional liquid at the same rate that the middle bellows contracts. The discharge valve 38 moves upwardly in the bore 42 until it reaches the position shown in FIG. 10A, and continued upward movement of the sleeve 20 closes the control valve 44 as the sleeve 20 returns to the position shown in FIG. 10A. The fill cycle is then repeated.

Since the opening and closing of the valves 44 and 38 are controlled in response to displacement of the upper sleeve 18, the timing of the valves can be accurately adjusted.

An important feature of this invention is the arrangement for quickly and efficiently drawing the liquid product from the unit. When the components are positioned as shown in FIG. 7, the entire liquid contents drain from top to bottom by gravity through the discharge nozzle 4. After draining, a cleaning solution can be run through the unit to flush out the liquid passages. All of the surfaces that are exposed to the liquid product are also exposed to the cleaning solution, so that the interior of the unit can be thoroughly cleaned.

If the liquid product contains chunks or particles, it can be seen that the valves are arranged so that particles are not trapped during opening or closing of the valves. Unlike pressure-responsive valves which utilize springs, the area around the valve elements of this invention are relatively free of obstructions, so that the chunks and particles flow freely through the dispensing unit.

Since there are only two locations in the unit where there is relative sliding contact between components, namely the valve element 44 and the valve element 38, the unit has a long service life. In the event that these elements become worn, the valve elements and the valve stem 36 can easily be replaced.

While this invention has been illustrated and described in accordance with a preferred embodiment, it is recognized that variations and changes may be made therein without departing from the invention as set forth in the claims.

What is claimed is:

1. Apparatus for dispensing liquids comprising a discharge nozzle having an internal bore, said bore having a central axis, a movable discharge valve element cooperating with said bore to control liquid flow out of said nozzle, a valve stem extending from said discharge valve element and along said central axis, a pair of sleeves arranged coaxial with said valve stem, a first one of said sleeves being spaced from said discharge element a greater distance than the second one of said sleeves, a first bellows between said nozzle and said second sleeve, and a second bellows between said first sleeve and said second sleeve, a third bellows connected with said first sleeve and arranged coaxial with said valve stem, liquid supply means for introducing liquid into said third bellows, said first sleeve being connected with said valve stem for imparting reciprocating motion to said valve stem upon axial movement of said first sleeve, said valve stem having a control valve element in position to cooperate with said second sleeve to selectively open and close liquid flow between said first and second bellows, and said second sleeve being mounted for axial reciprocating motion relative to said discharge nozzle.

2. The apparatus according to claim 1, including support means for mounting said valve stem with said axis substantially vertical.

3. The apparatus according to claim 1, including drive means for imparting reciprocating motion to said first and second sleeves according to a predetermined time and displacement schedule.

4. The apparatus according to claim 1, wherein said discharge valve element includes a lip that is received in said bore when said valve stem raised relative to said nozzle, said bore including a shoulder spaced from the discharge end of said nozzle, said shoulder being arranged to engage said valve element adjacent said lip for sealing against liquid flow between said shoulder and said valve element.

5. The apparatus according to claim 1, wherein said discharge valve element includes a peripheral lip projecting outwardly, said lip being formed of a flexible material to form a seal with said nozzle bore when the discharge valve element is received in said bore.

6. The apparatus according to claim 1, wherein said second sleeve includes guide means for engagement by said central valve element while allowing liquid flow between said control valve element and said sleeve.

7. The apparatus according to claim 6, wherein said guide means extends axially on both sides of said sleeve to guide said control valve element when said element is displaced away from alignment with said sleeve.

8. The apparatus according to claim 1, wherein said discharge valve element and said control valve element and said valve stem are integral with each other.

9. Apparatus for dispensing liquids comprising:

a machine frame, a discharge nozzle having an internal bore, said bore having a central axis, support means on said frame for supporting said nozzle in a fixed position, first and second sleeves arranged coaxial with said central axis, a discharge valve element mounted for reciprocating movement along said central axis into and out of said bore, said discharge valve element including a valve stem extending axially through said second sleeve and being secured in said first sleeve, said valve stem including a control valve element in position for reciprocating movement into and out of alignment with said second sleeve, a first bellows mounted between said nozzle and said second sleeve, a second bellows mounted between said second sleeve and said first sleeve, a third bellows mounted between said first sleeve and a liquid inlet means, support means on said frame for supporting said liquid inlet means at a fixed position, and said first, second and third bellows being coaxial with said central axis, whereby relative axial motion of said first and second sleeves selectively controls the discharge of liquid out of said nozzle at a predetermined rate.

10. The apparatus according to claim 9, wherein said first sleeve includes a hub in which said valve stem is secured, and said sleeve includes liquid passages for providing liquid communication between said third bellows and said second bellows.

11. The apparatus according to claim 9, wherein said second sleeve includes an internal valve surface in position to cooperate with said control valve element, and includes guides extending axially on opposite sides of said valve surface for allowing liquid flow between said first and second bellows when said control valve element is aligned with said guide means.

12. The apparatus according to claim 9, wherein said frame includes means for maintaining said first and second sleeves in axial alignment during reciprocating movement of said sleeves relative to said inlet means and said nozzle.

13. A method of dispensing liquids into cartons comprising (a) providing a fixed nozzle above a carton that is to be filled, said nozzle having a discharge valve element mounted for reciprocating axial movement into and out of the nozzle, (b) providing first and second sleeves in substantially axial alignment with said nozzle, with a first bellows mounted between said nozzle and said second sleeve a second bellows mounted between said second sleeve and said first sleeve, and a third bellows mounted between said first sleeve and a liquid inlet, said first, second and third bellows being mounted in substantially vertical alignment, with a valve stem extending axially through said first and second bellows and being movable in response to axial movement of said first sleeve, and a control valve element on said valve stem, (c) displacing said first sleeve toward said nozzle while maintaining said second sleeve in alignment with said central valve element, (d) displacing said discharge valve element out of said nozzle to allow discharge of liquid from the nozzle while displacing said second sleeve toward said nozzle at a predetermined rate to compensate for the loss of liquid from the first bellows, (e) displacing said discharge valve element upwardly into said nozzle while displacing said control valve element out of alignment with said second sleeve while raising said second sleeve to expand said first bellows and thereby recharging the first bellows, and repeating steps (c), (d), and (e).

14. The method according to claim 13, including displacing said first sleeve toward said nozzle to open said control valve element and said discharge valve element to the flow of liquid through said second sleeve and through said nozzle for draining and cleaning.

* * * * *